United States Patent [19]

Descouls et al.

[11] Patent Number: 4,772,429

[45] Date of Patent: Sep. 20, 1988

[54] PROCESS FOR THE EXTRACTION OF URANIUM (VI) AND/OR PLUTONIUM (IV) PRESENT IN AN AQUEOUS SOLUTION BY MEANS OF N,N-DIALKYLAMIDES

[75] Inventors: Nicole Descouls, Saint Jean de Maurienne; Jean-Claude Morisseau, Mennecy; Claude Musikas, Bures sur Yvette, all of France

[73] Assignee: Commissariat a l'Energie Atomique, Paris, France

[21] Appl. No.: 937,113

[22] Filed: Dec. 2, 1986

[30] Foreign Application Priority Data

Dec. 5, 1985 [FR] France ..... 85 18015

[51] Int. Cl.[4] ..... C01G 43/00; C01G 56/00

[52] U.S. Cl. ..... 252/625; 423/9; 252/626; 252/631

[58] Field of Search ..... 423/9; 252/625, 626, 252/631

[56] References Cited

U.S. PATENT DOCUMENTS 4,572,802 2/1986 Hubert et al. ..... 423/9

4,574,072 3/1986 Horwitz et al. ..... 423/9

OTHER PUBLICATIONS

Gasparini et al., *Sep. Sci. Technol.*, 15 (#4), 825–44 (1988).

Siddall et al., *J. Inorg. Nucl. Chem.*, 29, pp. 149–158 (1967), Pergamon Press.

*Primary Examiner*—Edward A. Miller

*Attorney, Agent, or Firm*—Pearne, Gordon, McCoy & Granger

[57] ABSTRACT

The invention relates to a process for the extraction of uranium (VI) and/or plutonium (IV) present in an aqueous solution by means of N,N-dialkylamides.

These N,N-dialkylamides are in accordance with formula:

(I)

in which $R^1$ is a straight or branched alkyl radical with 2 to 12 carbon atoms, $R^2$ and $R^4$, which can be the same or different, are straight or branched alkyl radicals with 2 to 6 carbon atoms, $R^3$ and $R^5$, which can be the same or different, are straight or branched alkyl radicals with 1 to 6 carbon atoms and a and b, which can be the same or different, are integers between 1 and 6.

For example, it is possible to use N,N-di-(2-ethyl hexyl)-2,2-dimethyl butyramide, N,N-di-(2-ethyl hexyl)-hexanamide or N,N-di-(2-ethyl hexyl)-dodecanamide for simultaneously extracting uranium and plutonium, or for separating the uranium from the plutonium without reducing the latter.

11 Claims, 6 Drawing Sheets

PROCESS FOR THE EXTRACTION OF URANIUM (VI) AND/OR PLUTONIUM (IV) PRESENT IN AN AQUEOUS SOLUTION BY MEANS OF N,N-DIALKYLAMIDES

BACKGROUND OF THE INVENTION

The present invention relates to a process for the extraction of U (VI) ions and/or Pu (IV) ions present in an acid aqueous solution by means of N,N-dialkylamides.

It more particularly applies to the recovery of uranium and optionally plutonium present in nitric dissolving solutions obtained during the first stage of reprocessing irradiated nuclear fuels.

One of the conventional procedures for reprocessing irradiated nuclear fuels is to firstly dissolve the fuel material in a nitric solution, followed by the treatment of said solution by extraction using an organic solvent for separating the uranium and plutonium from the fission products and then separating the uranium from the plutonium.

For the first extraction operation, use is generally made of an organic solvent constituted by tributyl phosphate and the uranium is then separated from the plutonium extracted in the organic solvent by contacting the latter with a nitric aqueous solution containing reducing agents in order to reduce the plutonium (IV) into plutonium (III) and to pass it into the aqueous solution. This process which is widely used on an industrial scale suffers from certain disadvantages, which are in particular linked with the use of tributyl phosphate as the extractant.

Thus, the chemical and radiolytic degradation products of tributyl phosphate are disturbing, because they give insoluble salts with most of the ions present in the reprocessing solutions, e.g. with U (VI), U (IV), Pu (IV), Pu (III), Zr (IV) and (III).

Moreover, the spent tributyl phosphate-based organic solvents cannot easily be processed by incinerating, because their incineration products are not solely constituted by volatile compounds.

The need to use reducing agents for bringing the plutonium to valency (III) with a view to the uranium-plutonium separation causes new problems which are difficult to solve.

Thus, the conventionally used reducing agents such as valency (II) iron, valency (IV) uranium or hydroxylamine ($NH_2OH$) are not stable in the presence of nitric acid because they have a tendency to be oxidized by it. To prevent this, an anti-nitrite agent, such as hydrazine ($NH_2$—$NH_2$) is added to the nitric solution.

However, the use of such reagents is seriously disturbed when the nitric solution also contains technetium, which is generally the case, because the tributyl phosphate also extracts a significant proportion of the technetium present in the irradiated nuclear fuel dissolving solutions. However, the presence of technetium catalyses the oxidation of the hydrazine by nitric acid, thus preventing the hydrazine from playing its part as the stabilizer of the reducing agents of Pu (IV). Therefore there is also an oxidation of the reducing agents, thus preventing the reduction of the plutonium and therefore its reextraction in the aqueous solution.

To obviate this disadvantage, it has been envisaged to increase the added hydrazine quantity, which naturally leads to an increase in the hydrazine decomposition products, such as hydrazoic acid, its salts and ammonium ions, which are undesirable products.

Thus, it is known that hydrazoic acid, which is very volatile and extractable in organic solvents, is liable to give unstable or explosive salts and this applies to a lesser extent for ammoniacal compounds. It is obviously undesirable to increase the explosion risks in an installation for the reprocessing of irradiated nuclear fuels.

It would also be of great interest to obviate the use of reducing agents and hydrazine in processes of this type, particularly as the $Pu^{3+}$ ions in the presence of $NO_3^-$ ions are out of equilibrium, because $E_{app}^o$ $Pu^{4+}/Pu^{3+}$ is substantially 0.92 V, whereas $E_{app}^o$ $NO_3^-/HNO_2$ is substantially 0.94 V in a $HNO_3$ medium at 1 mol.$l^{-1}$.

In addition, for some years now research has been carried out on the possibility of using organic extractants other than tributyl phosphate, in order to obviate these various disadvantages.

Thus, the use of N,N-dialkylamides has been envisaged and research carried out by the Oak-Ridge, Savannah River and Comitato Nazionale per l'Energia Nucleare laboratories have demonstrated that such extractants would have a good affinity for hexavalent and tetravalent ions of actinides, a low affinity for the main fission products, a good resistance to radiolysis and chemical degradation and a limited solubility in aqueous solution, whilst being easy to synthesize and purify, as described by T. H. Siddall in December 1960 in J. Phys. Chem., vol. 64, pp 1863–1866 and by G. M. Gasparini et al in Separation Science and Technology, 15 (4), pp 825–844, 1980.

However, it has not hitherto been possible to use these extractants because the tested uranyl nitrate and N,N-dialkylamide complexes tested have a limited solubility in organic solvents, particularly when using alkanes as the diluents for N,N-dialkylamides. In addition, the use of such extractants has not been considered on an industrial scale.

SUMMARY OF THE INVENTION

The present invention relates to the use of novel N,N-dialkylamides for the extraction of uranium and/or plutonium present in nitric solutions from the reprocessing of irradiated nuclear fuels obviating the disadvantage referred to hereinbefore.

Therefore the present invention specifically relates to a process for the extraction in an organic phase of the uranium (VI) and/or plutonium (IV) present in an acid aqueous solution by contacting said solution with said organic phase, wherein the organic phase comprises an inert diluent and at least one extractant constituted by N,N-dialkylamide of formula:

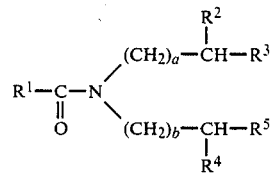

(I)

in which $R^1$ is a straight or branched alkyl radical with 2 to 12 carbon atoms, $R^2$ and $R^4$, which can be the same or different, are straight or branched alkyl radicals with 2 to 4 carbon atoms, $R^3$ and $R^5$, which can be the same or different, are straight or branched alkyl radicals with 1 to 6 carbon atoms and a and b, which can be the same or different, are integers between 1 and 6.

In said formula, a and b are generally both equal to 1.

Preferably, the radicals $R^2$ and $R^4$ both represent the ethyl radical.

Thus, it would appear that the presence of said ethyl radical makes it possible to improve the solubility of complexes of uranyl nitrate and N,N-dialkylamides corresponding to the formulas:

$$UO_2(NO_3)_2L_2 \text{ and } UO_2(NO_3)_3HL$$

in which L represents N,N-dialkylamide, in organic phases using aliphatic carbides as the diluent.

Thus, by using such N,N-dialkylamides, it is possible to obtain a solubility of the uranium complexes of at least 100 g of uranium per liter of organic phase, which is adequate on an industrial scale.

Thus, with the N,N-dialkylamides according to the invention, it is possible to use as the diluent aliphatic carbides, such as straight or branched saturated hydrocarbons and therefore obtain the following advantages:

the organic phase has a low density, which makes it possible to ensure the decanting or settling of the phases under optimum conditions and the saturated hydrocarbons have a better chemical stability in the nitric medium, higher flash points and they are less toxic than aromatic carbides, which have previously had to be used as diluents.

Examples of N,N-dialkylamides which can be used in the invention are:

N,N-di-(2-ethyl hexyl)-2,2-dimethyl butyramide (DOTA) of formula:

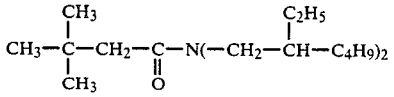

(II)

N,N-di-(2-ethyl hexyl)-hexanamide (DOHA) of formula:

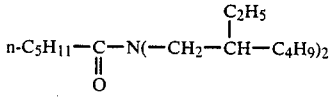

(III)

N,N-di-(2-ethyl hexyl)-dodecanamide (DODA) of formula:

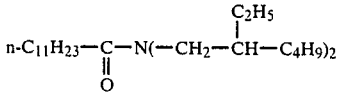

(IV)

N,N-di-(2-ethyl hexyl)-octanamide (DOOA) of formula:

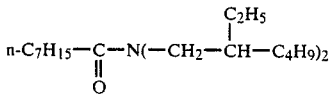

The N-N-dialkylamides used in the invention can be prepared by conventional processes by reacting acid chloride of formula:

$$R^1COCl$$

with the secondary amine of formula:

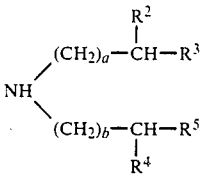

in which $R^1$, $R^2$, $R^3$, $R^4$, $R^5$, and a and b have the meanings given hereinbefore.

The secondary starting amines can be prepared by conventional processes, e.g. by reacting corresponding alcohols of formula:

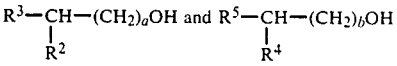

with ammonia. In this case, a mixture of primary, secondary and tertiary amines is formed and it is possible to separate the desired secondary amine by fractional distillation.

The formation of the N,N-dialkylamides of the invention corresponds to the following reaction diagram:

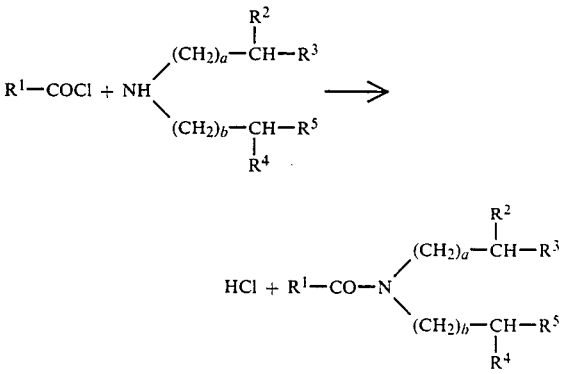

This is followed by the purification of the product obtained by distilling under reduced pressure and generally 99% pure amides are obtained.

The use of the dialkylamides according to the invention for the processing of aqueous solutions simultaneously containing uranium (VI) and plutonium (IV) is very interesting because, by regulating the acidity of the starting aqueous solution, which is generally a nitric solution, it is possible to either simultaneously extract the uranium (VI) and the plutonium (IV) or selectively extract the uranium (VI) whilst leaving the plutonium (IV) in aqueous solution without it being necessary to use reducing agents.

Thus, according to a first embodiment of the invention suitable for the processing of aqueous solutions simultaneously containing uranium (VI) and plutonium (IV), the acidity of the aqueous solution is regulated to a value of at least 2N for simultaneously extracting uranium (VI) and plutonium (IV) in the organic phase.

Preferably, in view of the fact that the extraction coefficient of uranium (VI) and plutonium (IV) increases with the acidity of the aqueous solution, the acidity thereof is regulated to a value of 3 to 10N in order to obtain the best plutonium and uranium extraction levels in the organic phase.

According to a second embodiment of the inventive process suitable for the processing of aqueous solutions simultaneously containing uranium (VI) and plutonium (IV), the acidity of the aqueous solution is regulated to a value of 0.5 to 1.2N for selectively extracting the uranium (VI) in the organic phase.

Thus, under such conditions, the uranium (VI) extraction level in the organic phase is much greater than that of plutonium (IV), which makes it possible to separate the uranium from the plutonium without it being necessary to reduce the plutonium to valency (III).

Preferably in the second embodiment of the process, use is made of a N,N-dialkylamide, in which the $R^1$ radical is a branched alkyl radical.

However, in the first embodiment of the process, use is preferably made of a N,N-dialkylamide, in which the $R^1$ radical is a straight alkyl radical.

In both embodiments of the inventive process the N,N-dialkylamide concentration of the organic phase is preferably 0.2 to 2 $mol.l^{-1}$.

Thus, the extraction level generally increases with the N,N-dialkylamide concentration of the organic phase. However, to maintain the viscosity and density of the organic phase in an appropriate range, the N,N-dialkylamide content of the organic phase is generally limited to a value of 1.5 $mol.l^{-1}$.

The diluents which can be used in the invention are inert organic diluents preferably having a not very high dielectric constant.

Examples of such diluents are benzene, xylene, mesitylene, tert butyl benzene, decanol and aliphatic hydrocarbons, particularly straight or branched saturated hydrocarbons.

Preferably, in the invention, the diluent used is an aliphatic hydrocarbon, particularly a straight or branched saturated hydrocarbon such as dodecane, e.g. the product sold under the trade name Hyfran because, as has been shown hereinbefore, the use of such diluents makes it possible to obtain numerous advantages.

The process according to the invention can be performed in any conventional extraction apparatus, such as mixer-settlers, pulsed columns, centrifugal extractors, etc.

Generally, working takes place at ambient temperature and pressure with aqueous phase/organic phase volume ratios between 10 and 0.1.

The uranium (VI) and plutonium (IV) extracted in the organic phase can then be recovered with very good yields at ambient temperature by contacting the organic solvent with dilute nitric acid (0 to 0.2N) for uranium (VI) and more concentrated nitric acid (0.5 to 1.5N) for Pu (IV).

The use of the extractants according to the invention is of great interest and makes it possible to obtain certain advantages compared with the use of tributyl phosphate.

Thus, the uranium (VI) and plutonium (IV) extraction levels are high and substantially equivalent to those obtained with tributyl phosphate. The N,N-dialkylamide degradation products are not very disturbing, whereas in the case of tributyl phosphate this is not the case because they generally precipitate. N,N-dialkylamides can be destroyed by incinerating giving only gaseous waste, whereas tributyl phosphate gives phosphoric acid as the main waste product.

N,N-dialkylamides make it possible to directly separate uranium (VI) from plutonium (IV), whereas in the case of tributyl phosphate it is necessary to use reducing agents such as hydrazine and hydroxylamine.

The reextraction of uranium (VI) from the organic phase can easily be carried out at ambient temperature, whereas in the case of tributyl phosphate, it is necessary to operate hot.

The use of N,N-dialkylamides makes it possible to easily separate the zirconium from the uranium (VI) and plutonium (IV), which was not the case with tributyl phosphate.

Moreover, the synthesis and purification of the N,N-dialkylamides according to the invention causes no particular problem and they can consequently be produced at advantageous prices.

BRIEF DESCRIPTION OF THE DRAWINGS

Other advantages and features of the invention can be gathered from the following non-limitative, exemplified description, with reference to the attached drawings, wherein show.

DETAILED DESCRIPTION OF THE INVENTION

Example 1

This example illustrates the extraction of U (VI) on the basis of a nitric aqueous solution containing $10^{-4}$ $mol.l^{-1}$ of U (VI). This example uses an organic phase constituted by the product sold under the trade name Hyfran 120, which is branched dodecane containing 0.5 $mol.l^{-1}$ of N,N-di-(2-ethyl hexyl)-2,2-dimethyl butyramide (DOTA). For carrying out the extraction, the organic phase and the aqueous phase containing U (VI) with an organic phase/aqueous phase volume ratio equal to 1 are contacted acccompanied by stirring.

After stirring for 4 minutes, the two phases are allowed to settle, followed by the measurement of their concentrations in U (VI). This is followed by the determination of the distribution coefficient of U (VI): $D_{U(VI)}$, which corresponds to the ratio of the concentration of the element, i.e. U (VI) in the organic phase to the concentration of said same element in the aqeous phase. These operations are repeated using aqueous solutions of different acidity and with the same U(VI) concentration.

Figure 1:
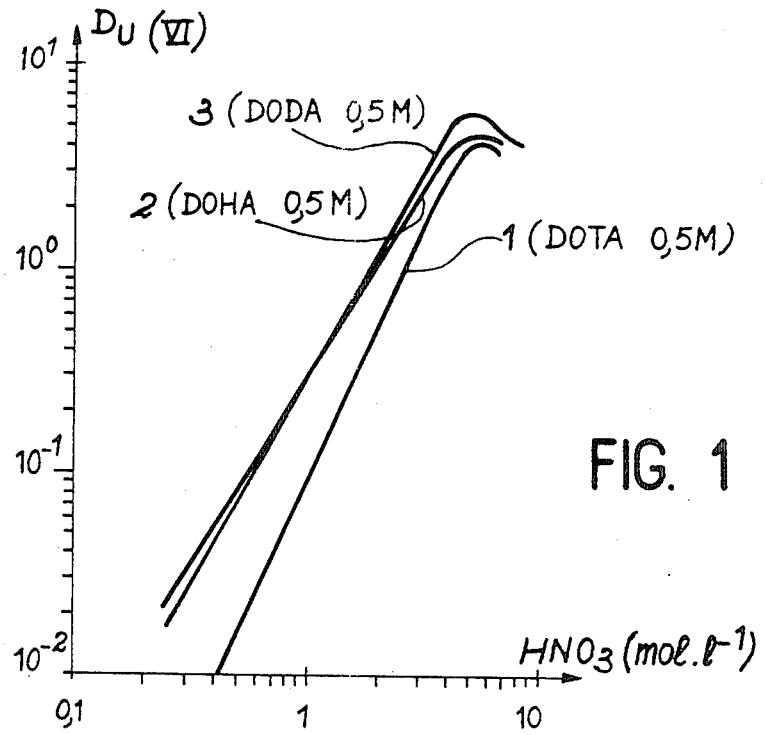
FIGS. 1 to 6 Graphs illustrating the variations of the distribution coefficient of Pu (IV) or U (VI), as a function of the nitric acid concentrations of the aqueous starting solution or the N,N-dialkylamide concentrations of the organic phase.

The results obtained are given in FIG. 1, where curve 1 illustrates the variations of the uranium $D_{U(VI)}$ distribution coefficient as a function of the nitric acid concentration (in $mol.l^{-1}$).

These results show that the extraction of uranium (VI) increases greatly with the nitric acid concentration and that the best results are obtained for nitric acid concentrations exceeding 2 mol.l$^{-1}$, the maximum being observed for a nitric acid concentration of approximately 5 mol.l$^{-1}$.

Example 2

This example uses the same operating procedure as in example 1, but uses an organic phase constituted by Hyfran 120 containing 0.5 mol.l$^{-1}$ of N,N-di-(2-ethyl hexyl)-hexanamide (DOHA).

The results obtained are represented by curve 2 in FIG. 1, which illustrates the variations in the distribution coefficient of uranium $D_{U(VI)}$ as a function of the nitric acid concentration.

As in the case of example 1, the best results are obtained for nitric acid concentrations exceeding 2 mol.l$^{-1}$ and the maximum is observed for a concentration of approximately 5 mol.l$^{-1}$.

Example 3

The same operating procedure as in example 1 is used, but the organic phase is constituted by Hyfran 120 containing in solution 0.5 mol.l$^{-1}$ of N,N-di-(2-ethyl hexyl)dodecanamide (DODA).

The results obtained are represented by curve 3 of FIG. 1, which illustrates the variations of the $D_{U(VI)}$ distribution coefficient as a function of the nitric acid concentration.

As in the case of examples 1 and 2, the best results are obtained for a nitric acid concentration exceeding 2 mol.l$^{-1}$ and the maximum is also observed for a concentration of approximately 5 mol.l$^{-1}$.

On examining the results obtained in examples 1 to 3, it can be seen that the nature of the $R^1$ radical has little influence on the result obtained.

Example 4

This example studies the influence of the N,N-dialkylamide concentration on the extraction of U (VI) ions.

Use is made of a nitric aqueous solution containing $10^{-4}$ mol.l$^{-1}$ of U (VI) and 0.98 mol.l$^{-1}$ of $HNO_3$ and an organic phase constituted by Hyfran 120 containing variable quantities of the N,N-dialkylamide used in example 1 (DOTA).

Extraction takes place under the same conditions as in example 1 and the distribution coefficient of U(VI) is also determined.

Figure 2:
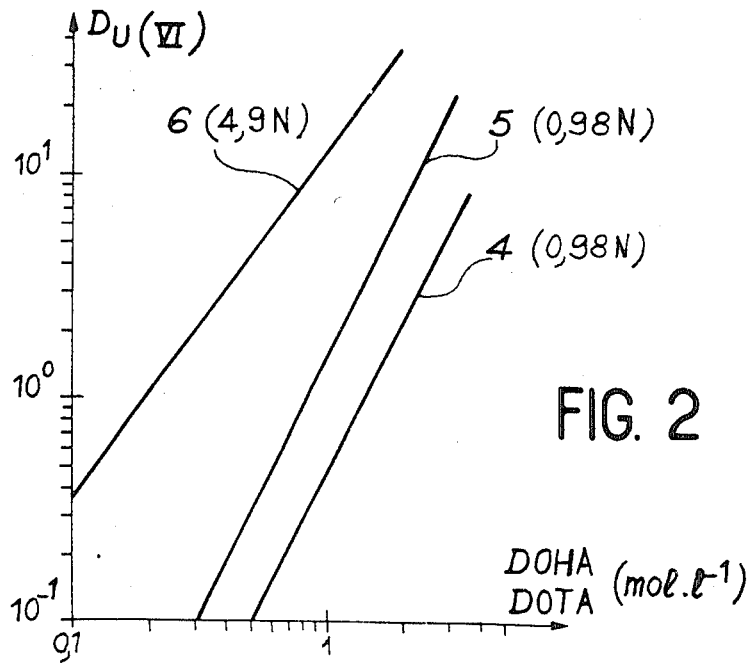

The results obtained are given in FIG. 2, where line 4 represents the variations of the distribution coefficient of $D_{U(VI)}$ as a function of the DOTA concentration of the organic phase (in mol.l$^{-1}$). Thus, the distribution coefficient increases with this concentration.

Example 5

This example adopts the same operating procedure as in example 4, but using the N,N-dialkylamide of example 2 (DOHA).

The results obtained are represented by line 5 in FIG. 2, which shows that the distribution coefficient of the uranium increases with the DOHA concentration of the organic phase.

Example 6

In this example, the same operating procedure as in example 4 is followed, but the nitric aqueous solution has a nitric acid concentration of 4.9 mol.l$^{-1}$.

The results obtained are represented by line 6 of FIG. 2 and it can be seen that the distribution coefficients are higher and increase with the DOTA concentration of the organic phase.

If this operating procedure was repeated with the N,N-dialkylamide of example 2 (DOHA), equivalent results would be obtained.

EXAMPLE 7

This example relates to the extraction of Pu (IV) present in a concentration of $5\times10^{-5}$ mol.l$^{-1}$ in a nitric aqueous solution.

Figure 3:
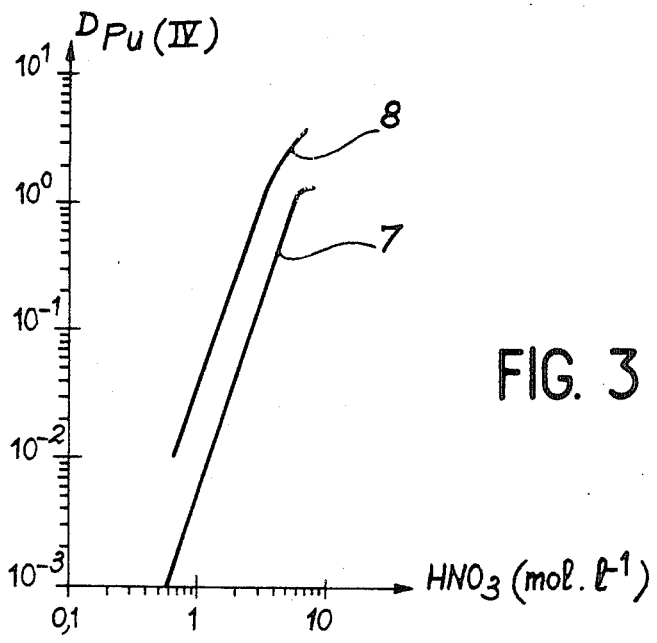

In this example, the organic phase is constituted by Hyfran containing 0.5 mol.l$^{-1}$ of N,N-dialkylamide of example 1 (DOTA) and the same operating procedure as in example 1 is adopted. The results obtained with respect to the extraction of plutonium (IV) are given in FIG. 3, where curve 7 represents the $D_{Pu(IV)}$ variations as a function of the nitric acid concentration (in mol.l$^{-1}$) of the aqueous solution in equilibrium, i.e. following contacting and separation of the two phases.

As in the case of uranium (VI), plutonium extraction increases with the acidity of the aqueous solution and the best results are obtained for a nitric acid concentration of 5 mol.l$^{-1}$.

Example 8

This example uses the same operating procedure as in example 7, but using the N,N-dialkylamide of example 2 (DOHA). The results obtained are represented by curve 8 of FIG. 3.

These results show that the plutonium extraction increases with the nitric acid concentration and that the best results are obtained when the $R^1$ radical of N,N-dialkylamide is straight.

Example 9

The same operating procedure as in example 7 is followed, but using a nitric aqueous solution with a nitric acid concentration of 0.98 mol.l$^{-1}$ and by varying the N,N-dialkylamide (DOTA) concentration of the organic phase.

Figure 4:
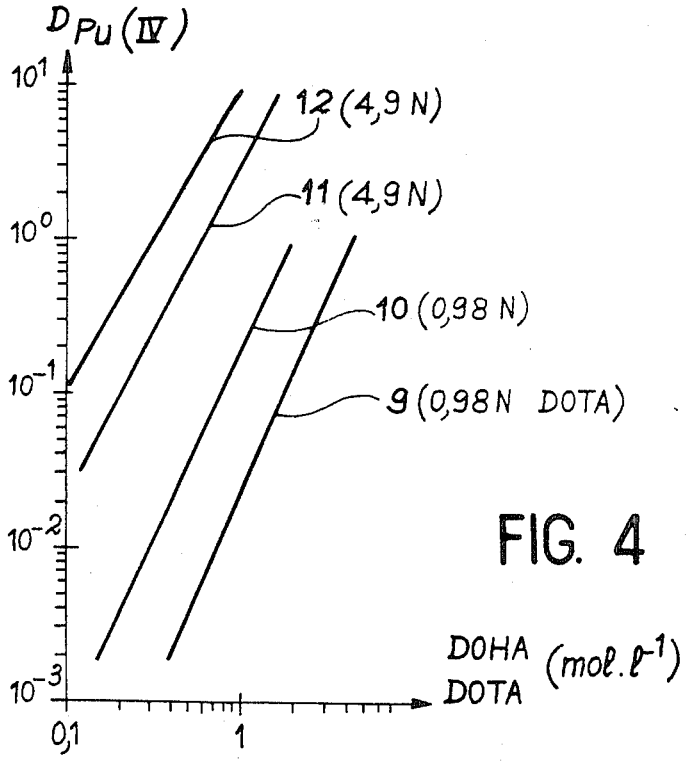

The results obtained are given in FIG. 4 (line 9), which indicates that the Pu(IV) distribution coefficient increases with the N,N-dialkylamide concentration of the organic phase.

Example 10

This example follows the same operating procedure as in example 9, but uses the N,N-dialkylamide of example 2 (DOHA).

The results obtained are given by line 10 of FIG. 4, which also shows that the extraction of plutonium (IV) increases with the DOHA concentration of the organic phase.

Example 11

The same operating procedure as in example 9 is adopted, but using a nitric aqueous solution having a nitric acid concentration of 4.9 mol.l$^{-1}$.

The results obtained are given by line 11 of FIG. 4, which shows that the plutonium extraction level increases with the DOTA concentration.

Example 12

The same operating procedure as in example 10 is adopted, but using an aqueous solution having a nitric acid concentration of 4.9 mol.l$^{-1}$. The results obtained are given by curve 12 of FIG. 4, which shows that the plutonium (IV) extraction level also increases with the DOHA concentration of the organic phase.

On the basis of the results given in FIG. 4, it should also be noted that the use of a straight $R^1$ radical makes it possible to obtain better results for the extraction of plutonium (IV).

Example 13

This example follows the same operating procedure as in example 1, but uses as the aqueous solution a nitric aqueous solution containing $5\times10^{-5}$ mol.l$^{-1}$ of Pu (IV) and $10^{-4}$ mol.l$^{-1}$ of U (VI) and an organic phase constituted by Hyfran containing 1 mol.l$^{-1}$ of N,N-dialkylamide according to example 2 (DOHA).

Figure 5:
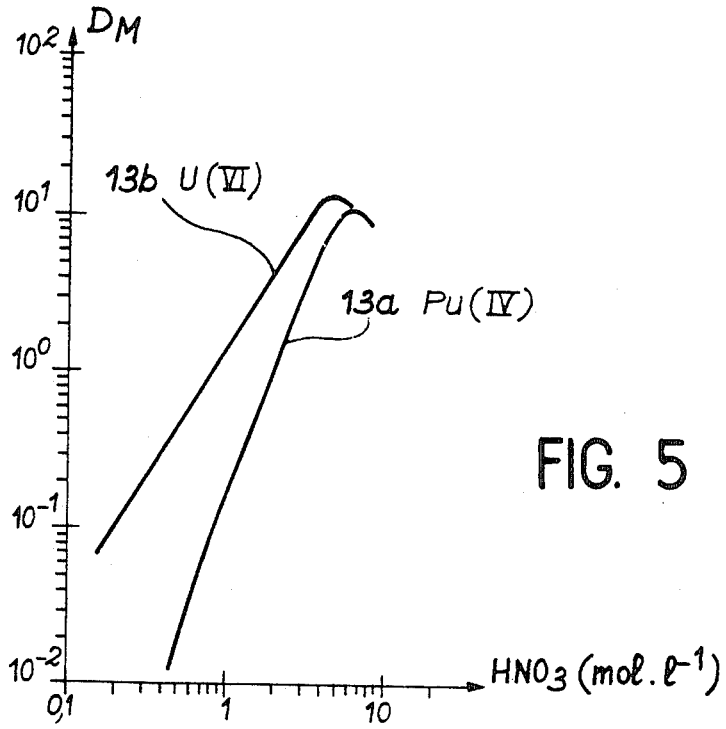

The results obtained are given in FIG. 5, where curve 13*a* represents the $D_{Pu(IV)}$ distribution coefficient as a function of the nitric acid concentration of the aqueous solution and curve 13*b* represents the distribution coefficient $D_{U(VI)}$ as a function of the nitric acid concentration of the aqueous solution.

These results show that a uranium-plutonium separation can be obtained for nitric acid concentrations below 2 mol.l$^{-1}$ and in particular for concentrations of 0.5 to 1.2 mol.l$^{-1}$.

Example 14

This example uses the same operating procedure as in example 13, but uses an organic phase constituted by Hyfran containing 0.5 mol.l$^{-1}$ of the N,N-dialkylamide of example 1 (DOTA).

Figure 6:
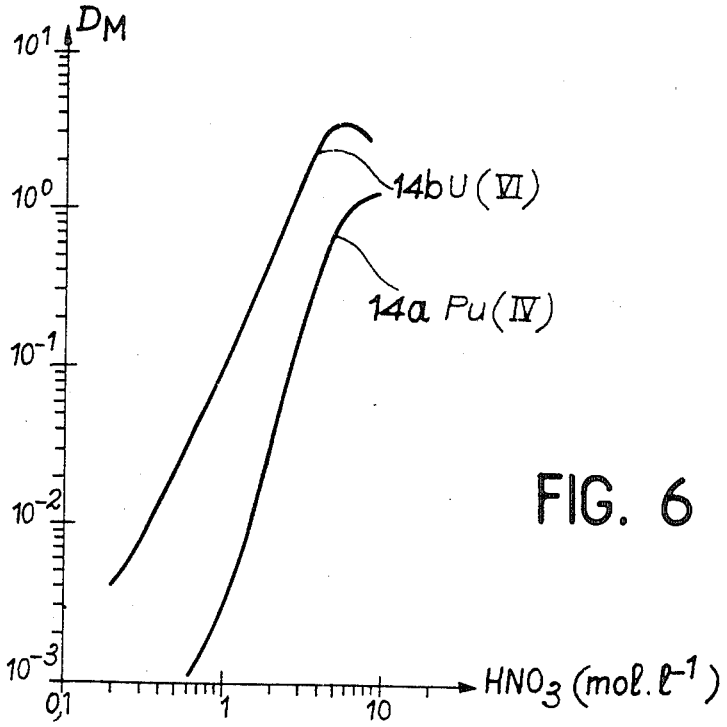

The results obtained are given in FIG. 6, where curve 14*a* illustrates the Pu(IV) distribution coefficient and curve 14*b* the U(VI) distribution coefficient. These results show that a uranium-plutonium separation is possible for nitric acid concentrations below 2 mol.l$^{-1}$.

Moreover, on comparing the results obtained in examples 13 and 14, it can be seen that better results are obtained for the simultaneous extraction of uranium (VI) and plutonium (IV) with N,N-dialkylamides whose $R^1$ radical is straight and that a better uranium (VI)-plutonium (IV) separation is obtained when the $R^1$ radical of the N,N-dialkylamide is branched. The nitric acidity for the separation should be approximately 1N and the nitric acidity for the co-extraction should be approximately 5N.

Example 15

This example illustrates the extraction of different fission products by the N,N-dialkylamides of the invention. This example uses a nitric aqueous solution containing zirconium ($5\times10^{-3}$ mol.l$^{-1}$), niobium ($10^{-9}$ mol.l$^{-1}$), ruthenium ($10^{-3}$ mol.l$^{-1}$), strontium $Sr^{2+}$($10^{-3}$ mol.l$^{-1}$), americium $Am^{3+}$($10^{-5}$ mol.l$^{-1}$) and europium $Eu^{3+}$ ($10^{-3}$ mol.l$^{-1}$).

The same operating procedure as in example 1 is used, but the organic phase is constituted by Hyfran containing 1 mol.l$^{-1}$ of the N,N-dialkylamide of example 2 (DOHA). As in example 1, the distribution coefficients of Zr, Nb, Ru, $Sr^{2+}$, $Am^{3+}$ and $Eu^{3+}$ are determined.

Figure 7:
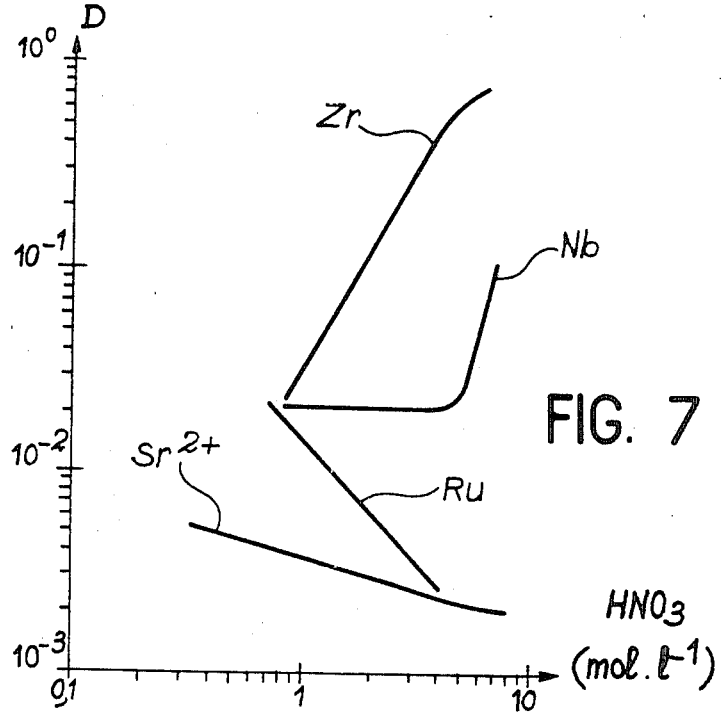
FIGS. 7 to 9 Graphs representing the variations of the distribution coefficients of different fission products and nitric acid as a function of the nitric acid concentration of the aqueous solution.

The results obtained are given in FIG. 7 for zirconium, niobium, ruthenium and strontium as a function of the nitric acid concentration of the aqueous solution in equilibrium. The distribution coefficient for americium 3+ and europium 3+ is below $10^{-3}$.

These results show that the extraction of zirconium and niobium increases with the nitric acid concentration, whereas the ruthenium and strontium extraction remains low and decreases with the nitric acid concentration.

Example 16

Figure 8:
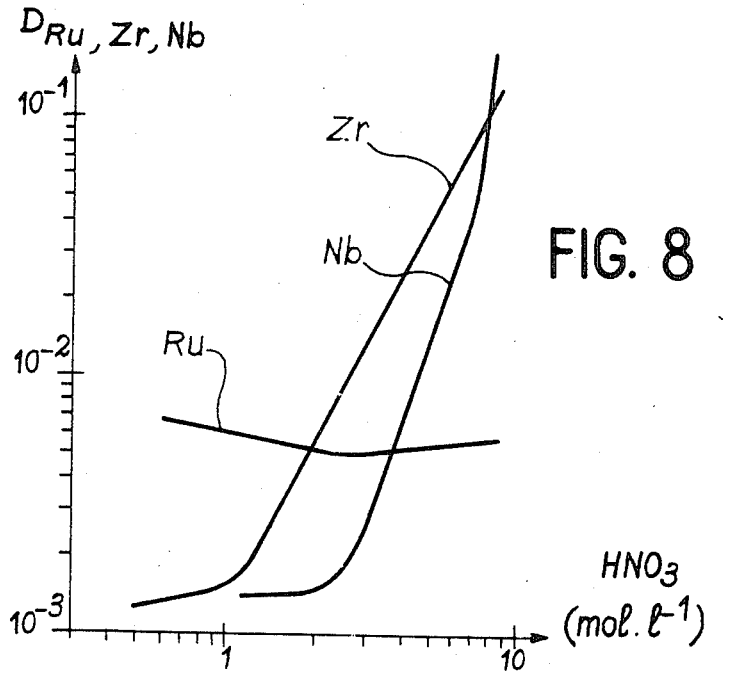

This example adopts the same operating procedure as in example 15, but uses the dialkylamide of example 1 (DOTA) instead of DOHA. The results obtained are given in FIG. 8 for ruthenium, zirconium and niobium.

These results show that the extraction of zirconium and niobium increases with the nitric acidity, whereas there is essentially no variation to the ruthenium extraction.

On comparing the results obtained in examples 15 and 16, it can be seen that the N,N-dialkylamide with a branched $R^1$ radical extracts less zirconium than N,N-dialkylamide whose $R^1$ radical is straight.

Example 17

This example studies the extraction of nitric acid by organic phases containing N,N-dialkylamides according to the invention. In this example, contacting takes place of nitric aqueous solutions having variable nitric acid concentrations and an organic phase constituted by Hyfran containing either 0.5 mol.l$^{-1}$ or 1 mol.l$^{-1}$ of the N,N-dialkylamide of example 2 (DOHA). Contacting of the aqueous phase and the organic phase takes place under the same conditions as in example 1 and, following the settling of the phases, the nitric acid concentration of the organic phase is determined in mol.l$^{-1}$.

Figure 9:
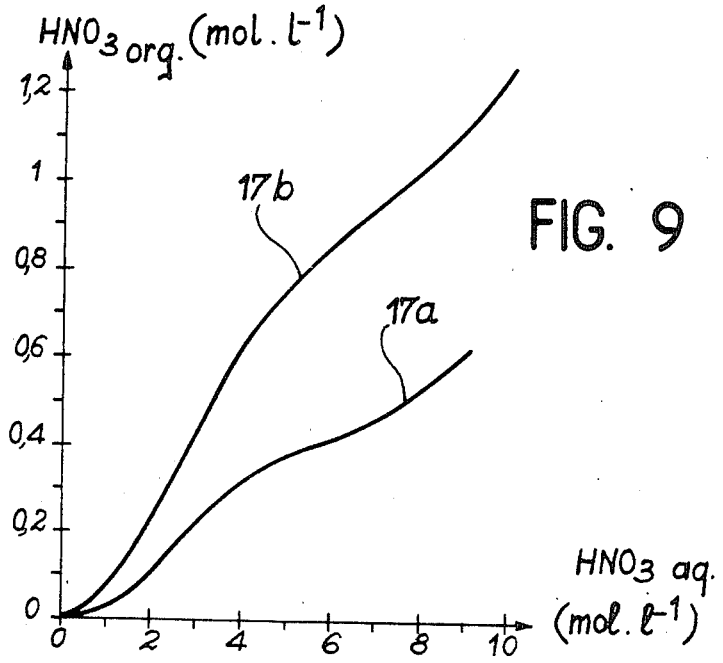

The results obtained are given in FIG. 9, where curves 17*a* and 17*b* illustrate the variations of the nitric acid concentrations of the organic phase as a function of the nitric acid concentration of the aqueous phase. Curve 17*a* relates to the organic phase containing 0.5 mol.l$^{-1}$ of DOHA and curve 17*b* to the organic phase containing 1 mol.l$^{-1}$ of DOHA.

These results show that for nitric acidities below 6 mol.l$^{-1}$, the extraction of nitric acid by the organic phase remains low on using an organic phase containing 0.5 mol.l$^{-1}$ of DOHA.

Example 18

This example uses the same operating procedure as in example 1 using nitric aqueous solutions containing $10^{-4}$ mol.l$^{-1}$ of U (VI), $5\times10^{-5}$ mol.l$^{-1}$ of Pu (IV) and $5\times10^{-3}$ mol.l$^{-1}$ of Zr (IV) and having different nitric acid concentrations and an organic phase constituted either by Dodecane containing 1.09 mol.l$^{-1}$ of tributyl phosphate or Hyfran containing 1 mol.l$^{-1}$ of DOHA. The distribution coefficients of U(VI), Pu (IV) and Zr (IV) are determined as in example 1.

Figure 10:
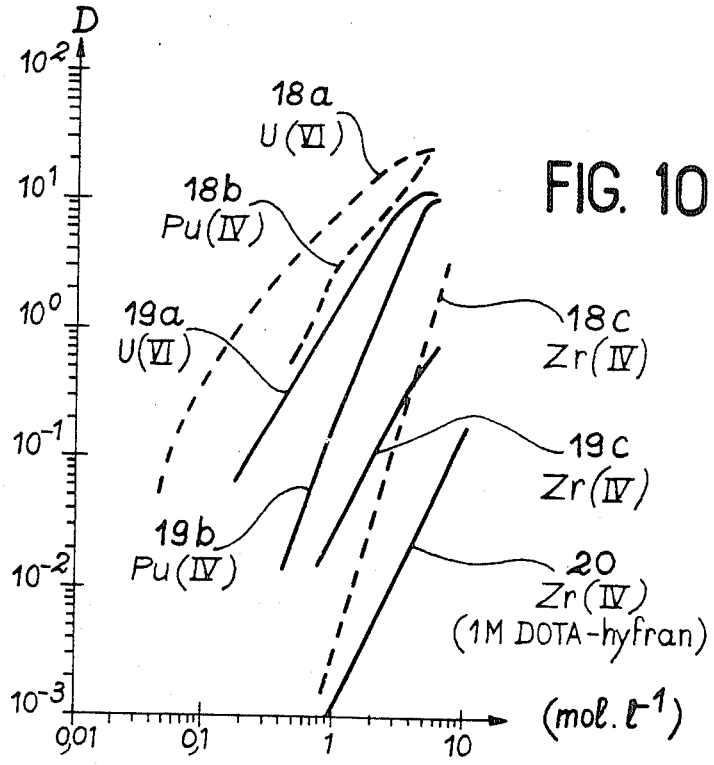
FIG. 10 A graph showing the variations of the distribution coefficients of U (VI), Pu(IV) and Zr (IV) as a function of the nitric acid concentration of the aqueous solution.

The results obtained are given in FIG. 10, where curves 18*a*, 18*b* and 18*c* respectively illustrate the variations of the distribution coefficients of U (VI), Pu (IV) and Zr (IV) as a function of the nitric acid concentration of the aqueous solution in the case of the organic phase constituted by dodecane containing 1.09 mol.l$^{-1}$ of tributyl phosphate and curves 19*a*, 19*b* and 19*c* respectively illustrate the distribution coefficients of U (VI), Pu (IV) and Zr (IV) as a function of the nitric acid concentration of the aqueous solution in the case of the organic phase containing 1 mol.l$^{-1}$ of DOHA.

FIG. 10 gives for comparison purposes the results obtained with respect to zirconium (IV) extraction under identical conditions with an organic phase constituted by Hyfran containing 1 mol.l$^{-1}$ of DOTA.

Examples 19 to 24

These examples study the influence of the nature of the N,N-dialkylamide used on the results obtained for the simultaneous extraction of uranium and plutonium on the basis of solutions having a nitric acid concentration exceeding 3 mol.l$^{-1}$.

In these examples, each organic phase with the composition given in the attached table is contacted with a nitric aqueous phase containing uranium, contacting taking place whilst stirring for 4 minutes. The two phases are then allowed to settle and their uranium and nitric acid or $H^+$ ion concentrations are determined. The results obtained are given in the attached table, which also shows how the uranium complex formed and extracted in the organic phase behaved and what was the uranium saturation percentage of the organic phase.

These results show that only the N,N-dialkylamides according to the invention (examples 21 to 24) make it possible to obtain a satisfactory uranium extraction (at least 100 g/liter), without there being a crystallization or precipitation of the extracted complex, or an organic phase separation phenomenon.

In example 23, a precipitate appears, but in this case the saturation percentage of the organic phase is 92% and it is possible to obtain satisfactory results using a higher organic phase/aqueous phase volume ratio.

Examples 25 to 29

In these examples a study is made of the influence of the nature of the N,N-dialkylamide used on the extraction of the uranium under conditions corresponding to uranium-plutonium separation.

In these examples, the same operating procedure is used as in examples 19 to 24, but the aqueous phases essentially contain no $H^+$ ions. The composition of the organic phases used is given in the attached table, together with the uranium and $H^+$ ion concentrations of the aqueous and organic phases following the separation of the two phases. The table also indicates the phenomena observed and the uranium saturation percentage of the organic phase.

These results show that only the N,N-dialkylamides of the invention (examples 25, 26 and 29) make it possible to obtain satisfactory results. Moreover, when using other N,N-dialkylamides (examples 27 and 28), precipitates are formed.

Example 30

This example adopts the same operating procedure as in example 1, but uses as the aqueous solution a nitric aqueous solution containing $5\times10^{-5}$ mol.l$^{-1}$ of Pu (IV) and $10^{-4}$ mol.l$^{-1}$ of U (VI) and an organic phase constituted by Hyfran containing 1.07 mol.l$^{-1}$ of N,N-dialkylamide (iDOPA) of formula:

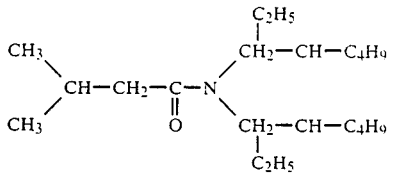

Figure 11:
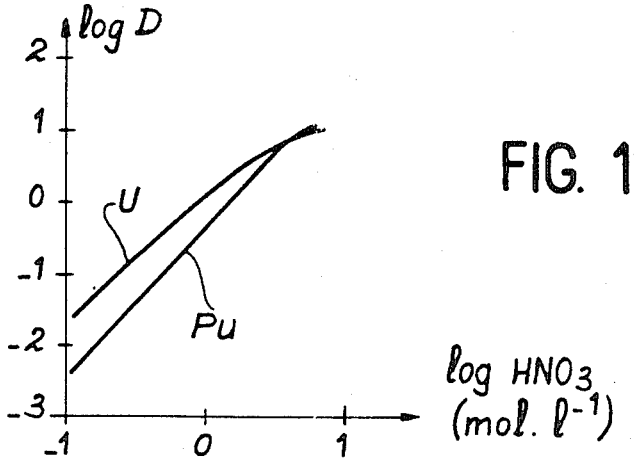
FIGS. 11 to 13 Graphs illustrating the variations of the distribution coefficients of U (VI) and Pu (IV) as a function of the nitric acid concentration of the aqueous solution for different N,N-dialkylamides.

The results obtained are given in FIG. 11 showing the variations of the distribution coefficients of plutonium (IV) and uranium (VI) as a function of the nitric acid concentration of the aqueous solution in logarithmic coordinates.

Example 31

This exam 1*e* adopts the same operating procedure as in example 30, but uses as the organic phase Hyfran containing 1.01 mol.l$^{-1}$ of N,N-dialkylamide (DOBA) of formula:

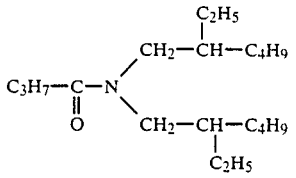

Figure 12:
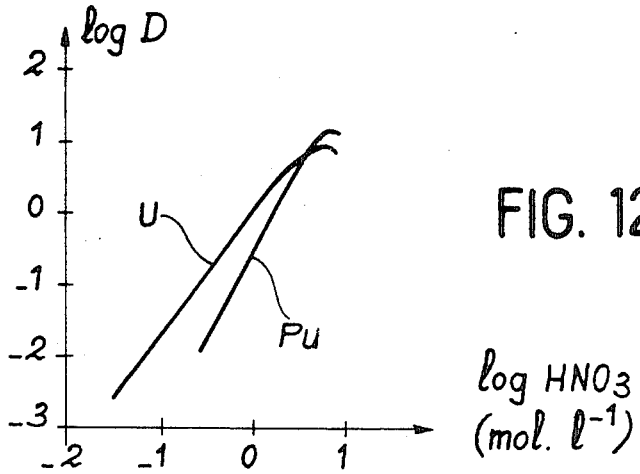

The results obtained are given in FIG. 12, which shows in logarithmic coordinates the variations of the distribution coefficients of uranium (VI) and plutonium (IV) as a function of the nitric acid concentration of the aqueous solution.

Example 32

The same operating procedure as in example 30 is followed, but use is made of an organic phase constituted by Hyfran containing 1.03 mol.l$^{-1}$ of N,N-dialkylamide (iDOBA) of formula:

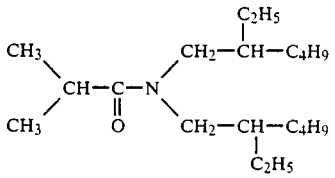

Figure 13:
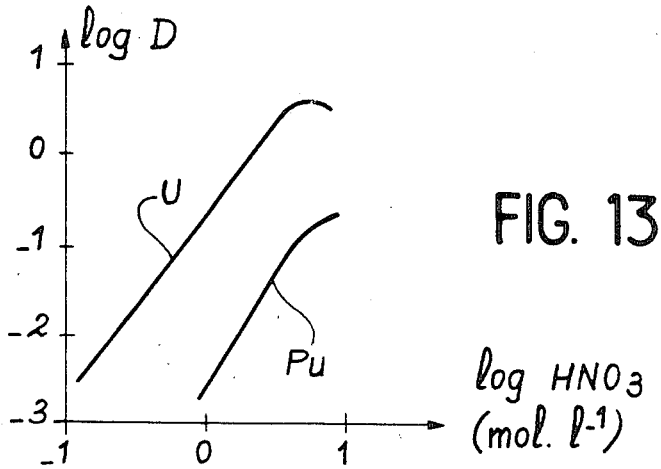

The results obtained are given in FIG. 13, which shows the variations of the distribution coefficients of U (VI) and Pu (IV) as a function of the nitric acid concentration of the aqueous solution.

The dialkylamides of examples 30 to 32 are of interest for U/Pu separation, because the solubility of the nitrated uranyl salts in these dialkylamides is high, approximately 150 g.l$^{-1}$ of uranium.

TABLE

| EX | Organic phase composition | U and $HNO_3$ or $H^+$ concentration of the phases: aqueous (mol.l$^{-1}$) | organic (mol.l$^{-1}$) | Phenomenon observed* | Percentage saturation of the organic phase |
|---|---|---|---|---|---|
| 19 | $C_{11}H_{23}-\underset{\underset{O}{\|}}{C}-N(C_4H_9)_2$ (DBDA) to 1 mol.l$^{-1}$ in dodecane | U = 0.5<br>$HNO_3$ = 4 | U = 0.30<br>$H^+$ = 0.55 | Separation, then crystallization of $UO_2(NO_3)_2(DBDA)_2$ | ~60 |

TABLE-continued

| EX | Organic phase composition | U and $HNO_3$ or $H^+$ concentration of the phases: aqueous ($mol.l^{-1}$) | organic ($mol.l^{-1}$) | Phenomenon observed* | Percentage saturation of the organic phase |
|---|---|---|---|---|---|
| 20 | $C_{11}H_{23}-C(=O)-N(-CH(CH_3)-CH-C_2H_5)_2$ ($D_5BDA$) to 1 $mol.l^{-1}$ in dodecane | U = 0.25<br>$HNO_3$ = 4 | U = 0.15<br>$H^+$ = 0.6 | Separation | ~30 |
| 21 | $C_5H_{11}-C(=O)-N-(CH_2-CH(C_2H_5)-C_4H_9)_2$ (DOHA) to 1 $mol.l^{-1}$ in dodecane | U = 0.42<br>$H^+$ = 4.55 | U = 0.43<br>$H^+$ = 0.2 | Soluble, then separation for the initial $HNO_3aq$ = 5.85 N | ~86 |
| 22 | DOHA to 1 $mol.l^{-1}$ in Hyfran | U = 0.39<br>$HNO_3$ = 5.62 | U = 0.43<br>$H^+$ = 0.38 | Soluble, then separation for initial $HNO_3aq$ > 6 N | ~86 |
| 23 | $CH_3-C(CH_3)_2-CH_2-C(=O)-N(-CH_2-CH(C_2H_5)-C_4H_9)_2$ (DOTA) to $mol.l^{-1}$ in Hyfran | U = 1.41<br>$H^+$ = 4.2 | U = 0.46<br>$H^+$ = 0.2 | Precipitate | ~92 |
| 24 | DOTA to 1 $mol.l^{-1}$ in Hyfran | U = 0.868<br>$H^+$ = 4.6 M | U = 0.43<br>$H^+$ = 0.24 | Soluble | ~86 |
| 25 | DOHA to 1 $mol.l^{-1}$ in dodecane | U = 1.6<br>$H^+ \cong 0$ | U = 0.5<br>$H^+ \cong 0$ | Soluble | 100 |
| 26 | DOHA to 1 $mol.l^{-1}$ in Hyfran | U = 1.5<br>$H^+ \cong 0$ | U = 0.49<br>$H^+ \cong 0$ | Soluble | 98 |
| 27 | DBDA to 1 $mol.l^{-1}$ in dodecane | U = 0.66<br>$H^+ \cong 0$ | U = 0.34<br>$H^+ \cong 0$ | Precipitate | 68 |
| 28 | $D_5BDA$ to 1 $mol.l^{-1}$ in dodecane | U = 0.33 A<br>$H^+ \cong 0$ | U = 0.27<br>$H^+ \cong 0$ | Precipitate | 54 |
| 29 | DOTA to 1 $mol.l^{-1}$ in Hyfran | U = 0.25<br>$LiNO_34$ | U = 0.485<br>$H^+ \cong 0$ | Soluble | 97 |

*Starts of precipitation or separation are indicated.

What is claimed is:

1. A process for the extraction in an organic phase of the uranium (VI) and/or plutonium (IV) present in an acid aqueous solution by contacting said solution with said organic phase, wherein the organic phase comprises an inert diluent and at least one extractant constituted by N,N-dialkylamide of formula:

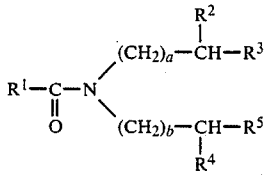

(I)

in which $R^1$ is a straight or branched alkyl radical with 2 to 12 carbon atoms, $R^2$ and $R^4$, which can be the same or different, are straight or branched alkyl radicals with 2 to 4 carbon atoms, $R^3$ and $R^5$, which can be the same or different, are straight or branched alkyl radicals with 1 to 6 carbon atoms and a and b, which can be the same or different, are integers between 1 and 6.

2. A process according to claim 1, wherein a and b are both equal to 1.

3. A process according to claim 1, wherein $R^2$ and $R^4$ both represent the ethyl radical.

4. A process according to claim 1, wherein $R^1$ is a branched alkyl radical.

5. A process according to claim 4, wherein N,N-dialkylamide corresponds to the formula:

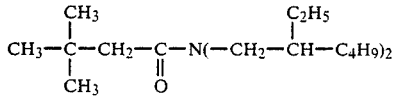

(II)

6. A process according to claim 1, wherein $R^1$ is a straight alkyl radical.

7. A process according to claim 6, wherein the N,N-dialkylamide is in accordance with formula:

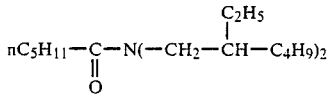

(III)

8. A process according to claim 6, wherein the N,N-dialkylamide is in accordance with the formula:

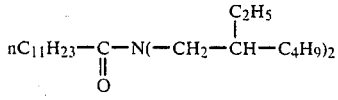

(IV)

9. A process according to any one of the claims 1 or 6 to 8, wherein the aqueous solution contains uranium (VI) and plutonium (IV) and wherein the acidity of said aqueous solution is at least 2N for the simultaneous extraction of uranium (VI) and plutonium (IV) in the organic phase.

10. A process according to any one of the claims 1, 4 or 5, wherein the aqueous solution simultaneously contains uranium (VI) and plutonium (IV) and wherein the acidity of said aqueous solution is in the range 0.5 to 1.2N for selectively extracting the uranium (VI) in the organic phase.

11. A process according to claim 1, wherein the inert diluent is a straight or branched saturated aliphatic hydrocarbon.

* * * * *